US010858910B2

(12) United States Patent
Feng et al.

(10) Patent No.: US 10,858,910 B2
(45) Date of Patent: Dec. 8, 2020

(54) HIGH-POWER MICROWAVE BOREHOLE FRACTURING DEVICE FOR ENGINEERING ROCK MASS

(71) Applicant: NORTHEASTERN UNIVERSITY, Shenyang (CN)

(72) Inventors: Xiating Feng, Shenyang (CN); Gaoming Lu, Shenyang (CN); Yuanhui Li, Shenyang (CN); Xiwei Zhang, Shenyang (CN); Jianhua Wen, Shenyang (CN); Tianyang Tong, Shenyang (CN); Yanhua Gong, Shenyang (CN)

(73) Assignee: NORTHEASTERN UNIVERSITY, Shenyang (CN)

( * ) Notice: Subject to any disclaimer, the term of this patent is extended or adjusted under 35 U.S.C. 154(b) by 74 days.

(21) Appl. No.: 16/317,738

(22) PCT Filed: May 16, 2018

(86) PCT No.: PCT/CN2018/087141

§ 371 (c)(1),
(2) Date: Jan. 14, 2019

(87) PCT Pub. No.: WO2019/213989

PCT Pub. Date: Nov. 14, 2019

(65) Prior Publication Data

US 2020/0040717 A1 Feb. 6, 2020

(30) Foreign Application Priority Data

May 11, 2018 (CN) ..... 2018 1 0446958

(51) Int. Cl.

| | |
|---|---|
| ***E21B 36/04*** | (2006.01) |
| ***E21B 43/26*** | (2006.01) |
| ***E21B 43/285*** | (2006.01) |

(52) U.S. Cl.
CPC ..... *E21B 36/04* (2013.01); *E21B 43/26* (2013.01); *E21B 43/285* (2013.01)

(58) Field of Classification Search
CPC ..... E21B 43/26; E21B 36/04; E21B 43/285; H01S 1/00; H05B 6/64; H05B 6/68; H05B 6/80
See application file for complete search history.

(56) References Cited

U.S. PATENT DOCUMENTS 5,003,144 A 3/1991 Lindroth et al.
5,449,889 A * 9/1995 Samardzija ..... A01M 1/06 166/248

(Continued)

FOREIGN PATENT DOCUMENTS

CL 108678761 A 10/2018
CN 104563883 A 4/2015

(Continued)

*Primary Examiner* — Michael R Wills, III
(74) *Attorney, Agent, or Firm* — Muncy, Geissler, Olds & Lowe, P.C.

(57) ABSTRACT

A high-power microwave borehole fracturing device for an engineering rock mass includes a high-power microwave generator, a high-power microwave coaxial heater, a high-power low-loss microwave coaxial transmission line, and a microwave power adaptive regulation and control system. The high-power microwave generator includes a continuous wave magnetron, a permanent magnet, a waveguide excitation chamber, a coaxial circulator, a coaxial matching load, a coaxial coupling converter, a waveguide coaxial converter, and an output waveguide. The high-power microwave coaxial heater includes a microwave transmission inner conductor, a microwave transmission outer conductor, a microwave input connector, a microwave short circuit cap, and a conductor supporting cylinder. The high-power low-loss microwave coaxial transmission line includes an input end coaxial line, middle section coaxial lines, and an output (Continued)

end coaxial line. The microwave power adaptive regulation and control system includes an impedance matching regulator, a microwave power controller, and a temperature sensor.

9 Claims, 11 Drawing Sheets

(56) References Cited

U.S. PATENT DOCUMENTS

| | | | | |
|---|---|---|---|---|
| 6,114,676 | A * | 9/2000 | Jerby | H05B 6/70 219/690 |
| 8,550,182 | B2 * | 10/2013 | Ouellet | E21B 7/15 166/302 |
| 2016/0341005 | A1 * | 11/2016 | Al-Buraik | E21B 47/07 |
| 2016/0341020 | A1 * | 11/2016 | Al-Buraik | E21B 43/26 |
| 2018/0363433 | A1 * | 12/2018 | Grounds, III | H05B 6/72 |

FOREIGN PATENT DOCUMENTS

| | | | |
|---|---|---|---|
| CN | 106769498 | A | 5/2017 |
| CN | 107035316 | A | 8/2017 |
| RU | 2012021 | C1 | 4/1994 |

* cited by examiner

HIGH-POWER MICROWAVE BOREHOLE FRACTURING DEVICE FOR ENGINEERING ROCK MASS

BACKGROUND OF THE INVENTION

1. Field of the Invention

The present invention relates generally to a borehole fracturing device, and more particularly, to provide a high-power microwave borehole fracturing device for an engineering rock mass.

2. The Prior Arts

A microwave-assisted rock fracturing technology is a new rock fracturing technology which has great potential. Before being cut by a mechanical tool, a rock is radiated and fractured by microwaves in advance, so that the mechanical properties, such as uniaxial compression, tensile strength and point load strength, of the rock can be reduced. The problem that the mechanical tool is easy to wear out when a hard rock is fractured with a mechanical method is solved, the rock fracturing efficiency can be improved, and the rock fracturing cost can also be reduced. Through the adoption of the microwave-assisted fracturing technology, the stress of a deep rock mass can be effectively released. The pre-fracturing of the rock mass is additionally provided on the basis of a stress release hole, so that a fracture zone is formed in the surrounding rock, the stress and the energy concentration level of the internal rock mass can be reduced, and therefore the risk of extremely strong rock burst can be effectively reduced.

In order to apply the microwave-assisted rock fracturing technology to the engineering rock mass for borehole fracturing, high-power microwaves need to be used for fracturing. Therefore, a high-power microwave fracturing device needs to be used, and a suitable microwave heater and a suitable microwave coaxial transmission line are also needed.

However, at present, most of conventional microwave generators use a box-type structure with a single-mode or multi-mode resonant chamber. The microwaves are reflected in the closed chamber, so that the rock in the chamber can absorb the microwaves. The frequency of the microwaves is 915 MHz or 2450 MHz, and the maximum power outputted by the microwaves is about 30 kW. Such type of microwave generators are only suitable for indoor tests and can be used for studying the influence of microwave radiation on the thermal physical properties and mechanical properties of the rock, but cannot meet the practical engineering application requirements. Although the 30 kW microwave power can meet the fracturing need of small-sized rock blocks, for the engineering rock mass in practical engineering, such microwave power is still too small. After the microwaves with such power are radiated to the engineering rock mass, the rate of temperature rise of the engineering rock mass is low, so that partial melting of the engineering rock mass can be caused, and the desired fracturing effect cannot be produced. Can stacking manner of multiple groups of small power be applicable? The answer is No. Because when a plurality of microwave heaters are stacked for heating, the microwave energy radiated by the microwave heaters is coupled or offset with each other before being absorbed by the engineering rock mass, and therefore rock fracturing cannot be achieved. In addition, some microwave generators that can meet high-power output requirements are industrial microwave generators being large in size, a magnetic field is provided through an electromagnet, and reflected power is isolated by using a Y-junction circulator. Such a microwave generator neither can be moved to the project site for application, nor can be combined with rock fracturing machinery.

At present, the conventional microwave heaters cannot meet the high-power borehole fracturing requirements due to low power capacity and small microwave radiation range. If high-power microwaves are forcibly input into the conventional microwave heaters, air ionization and breakdown sparking can be caused, so that the high-power microwave fracturing device is damaged.

At present, the structure of the conventional microwave coaxial transmission line cannot meet the high-power borehole fracturing requirements due to low power capacity and high microwave energy loss during remote transmission. In addition, an outer diameter dimension of the microwave coaxial transmission line cannot effectively meet the dimension requirement of the rock mass borehole, and on-site assembly and disassembly are inconvenient.

Further, the current technical scheme for fracturing the engineering rock mass by using microwaves mainly stays in the indoor test stage, and the microwave power outputted by the microwave generator acts on a rock sample in a constant state. However, since the temperature of the rock sample changes greatly, the microwave characteristics (dielectric constant, dielectric loss, and the like) of the rock sample can change greatly too, and finally, the load impedance of the rock sample can have dynamic characteristics. That is to say, when the load impedance of the rock sample changes dynamically, if the constant microwave power still acts on the rock sample, impedance mismatch can occur inevitably. The direct consequence is that the microwave reflected power increases, so that not only is the stability of microwave equipment reduced, but also the utilization efficiency of the microwave energy is reduced. Therefore, in order to successfully apply the microwave-assisted rock fracturing technology to practical engineering, the adaptive regulation and control of microwave power must be achieved, so that the real-time matching of impedance can be met when the load impedance of the rock changes dynamically.

SUMMARY OF THE INVENTION

A primary objective of the present invention is to provide a high-power microwave borehole fracturing device for an engineering rock mass, in which a high-power microwave generator, a high-power microwave coaxial heater, a high-power low-loss microwave coaxial transmission line and a microwave power adaptive regulation and control system are all new designed. The high-power microwave generator effectively meets the practical engineering application requirements, and a permanent magnet is used in the high-power microwave generator for the first time to provide a magnetic field. At the same time, a coaxial circulator is used in the high-power microwave generator for the first time to isolate microwave reflected power, so that the structure of the high-power microwave generator can be more compact, the size is substantially reduced, and the conditions for combining with rock fracturing machinery are further provided. The high-power microwave coaxial heater has higher power capacity and larger microwave radiation range, so that the high-power borehole fracturing requirement can be met effectively, and breakdown sparking due to air ionization can be effectively avoided. The high-power low-loss microwave coaxial transmission line has higher power capacity, and the microwave energy loss during remote transmission is small, so that the high-power borehole fracturing requirement can be met effectively, and on-site assembly and disassembly are convenient. The microwave power adaptive regulation and control system achieves the adaptive regulation and control of the microwave power, when the load impedance of the rock changes dynamically, the real-time matching requirement of impedance can be met, the stability of the microwave equipment is effectively improved, the microwave reflected power is reduced to the maximum extent, and application requirements of the microwave-assisted rock fracturing technology in practical engineering are effectively met.

The high-power microwave borehole fracturing device for an engineering rock mass includes a high-power microwave generator, a high-power microwave coaxial heater, a high-power low-loss microwave coaxial transmission line, and a microwave power adaptive regulation and control system; wherein the high-power microwave generator is connected with the high-power microwave coaxial heater through the microwave power adaptive regulation and control system and the high-power low-loss microwave coaxial transmission line sequentially; the high-power microwave coaxial heater is used for radiating microwave energy to cause fracturing of rocks around a borehole of the engineering rock mass; the microwave power adaptive regulation and control system is used for performing real-time impedance matching of a microwave power outputted by the high-power microwave generator; and the high-power low-loss microwave coaxial transmission line is used for transmitting impedance-matched microwaves into the high-power microwave coaxial heater.

The high-power microwave generator includes a continuous wave magnetron, a permanent magnet, a waveguide excitation chamber, a coaxial circulator, a coaxial matching load, a coaxial coupling converter, a waveguide coaxial converter, and an output waveguide; wherein the permanent magnet is a circular ring structure, and the permanent magnet is fixedly sleeved around an outer side of the continuous wave magnetron to provide a magnetic field for the continuous wave magnetron; the continuous wave magnetron is connected with a power supply through a wire, a microwave emitting head of the continuous wave magnetron is located in the waveguide excitation chamber, DC electrical energy is converted into microwave energy by the continuous wave magnetron, the microwave energy generated by the continuous wave magnetron enters the waveguide excitation chamber through the microwave emitting head, and a guided mode is formed in the waveguide excitation chamber; three end openings are formed in the coaxial circulator, and defined as a first end opening, a second end opening and a third end opening respectively; the waveguide excitation chamber is connected with the first end opening of the coaxial circulator through the coaxial coupling converter, and the microwave energy generated by the continuous wave magnetron enters the coaxial circulator after passing through the waveguide excitation chamber and the coaxial coupling converter sequentially; the output waveguide is connected with the second end opening of the coaxial circulator through the waveguide coaxial converter, the microwave energy in the coaxial circulator enters the output waveguide through the waveguide coaxial converter, and the microwave energy is converted from a coaxial output mode to a waveguide mode; the output waveguide is a microwave output portion of the high-power microwave generator; and the coaxial matching load is connected to the third end opening of the coaxial circulator, and the coaxial matching load is used for absorbing microwave reflected power isolated by the coaxial circulator and protecting the coaxial circulator and the continuous wave magnetron.

The high-power microwave coaxial heater includes a microwave transmission inner conductor, a microwave transmission outer conductor, a microwave input connector, a microwave short circuit cap, and a conductor supporting cylinder; wherein the microwave transmission inner conductor is a solid cylinder structure or a hollow cylinder structure, the microwave transmission outer conductor is a cylindrical structure, the microwave transmission outer conductor is coaxially sleeved around an outer side of the microwave transmission inner conductor, and the microwave transmission inner conductor and the microwave transmission outer conductor which are arranged in a coaxial sleeving state are fixedly mounted between the microwave input connector and the microwave short circuit cap; an annular space is formed among the microwave transmission inner conductor, the microwave transmission outer conductor, the microwave input connector and the microwave short circuit cap, and the annular space is stuffed by the conductor supporting cylinder which maintains a coaxial state between the microwave transmission inner conductor and the microwave transmission outer conductor; and a plurality of microwave radiating openings for radiating microwave energy outwards are formed in a cylinder wall of the microwave transmission outer conductor, and an anti-breakdown dielectric block is stuffed in each of the microwave radiating openings.

The conductor supporting cylinder and the anti-breakdown dielectric blocks are both made of a wave-transmitting material; the microwave transmission inner conductor, the microwave transmission outer conductor, the microwave input connector and the microwave short circuit cap are all made of a conductive metal material; each of the microwave radiating openings is in the shape of a curved slit, and a length of the curved slit of the microwave radiating opening is equal to ⅔ of a circumference of the microwave transmission outer conductor; the anti-breakdown dielectric blocks are exactly the same as the microwave radiating openings in shape and size, the microwave radiating openings are distributed in an axial direction of the microwave transmission outer conductor in an equidistant manner, and the adjacent microwave radiating openings face oppositely; a distance between the adjacent microwave radiating openings is $1/\sqrt{\varepsilon_r}$, wherein $\varepsilon_r$ is a relative dielectric constant of the wave-transmitting material; and a distance between the microwave radiating opening adjacent to the microwave short circuit cap and the microwave short circuit cap is $\frac{1}{2}\lambda_p$, wherein $\lambda_p=\lambda\sqrt{\varepsilon_r}$; wherein $\lambda_p$ is a phase wavelength, $\lambda$ is a microwave wavelength, and $\varepsilon_r$ is the relative dielectric constant of the wave-transmitting material.

The high-power low-loss microwave coaxial transmission line is a combined structure, and includes an input end coaxial line, middle section coaxial lines and an output end coaxial line, wherein the input end coaxial line is connected with the output end coaxial line through a plurality of middle section coaxial lines connected in series; the input end coaxial line includes an input end inner conductor, an input end outer conductor, an input end microwave input connector, an input end microwave output connector, and an input end conductor supporting disk; wherein the input end inner conductor is a solid cylinder structure or a hollow cylinder structure, the input end outer conductor is a cylindrical structure, and the input end outer conductor is coaxially sleeved around an outer side of the input end inner conductor; the input end microwave input connector is coaxially and fixedly connected to a front end aperture of the input end outer conductor, the input end conductor supporting disk is fixedly mounted between the input end inner conductor and the input end microwave input connector, and a coaxial state between the input end inner conductor and the input end outer conductor is maintained through the input end conductor supporting disk; and the input end microwave output connector is coaxially and fixedly connected to a rear end aperture of the input end outer conductor.

Each of the middle section coaxial lines includes a middle section inner conductor, a middle section outer conductor, a middle section microwave input connector, a middle section microwave output connector, and a middle section conductor supporting disk; wherein the middle section inner conductor is a solid cylinder structure or a hollow cylinder structure, the middle section outer conductor is a cylindrical structure, and the middle section outer conductor is coaxially sleeved around an outer side of the middle section inner conductor; the middle section microwave input connector is coaxially and fixedly connected to a front end aperture of the middle section outer conductor, the middle section conductor supporting disk is fixedly mounted between the middle section inner conductor and the middle section microwave input connector, and a coaxial state between the middle section inner conductor and the middle section outer conductor is maintained through the middle section conductor supporting disk; the middle section microwave output connector is coaxially and fixedly connected to a rear end aperture of the middle section outer conductor; and the middle section microwave input connector and the input end microwave output connector are in coaxial threaded connection and matching, or the middle section microwave input connector and the middle section microwave output connector of the adjacent middle section coaxial line are in coaxial threaded connection and matching.

The output end coaxial line includes an output end inner conductor, an output end outer conductor, an output end microwave input connector, an output end microwave output connector, an output end front conductor supporting disk, and an output end rear conductor supporting disk; wherein the output end inner conductor is a solid cylinder structure or a hollow cylinder structure, the output end outer conductor is a cylindrical structure, and the output end outer conductor is coaxially sleeved around an outer side of the output end inner conductor; the output end microwave input connector is coaxially and fixedly connected to a front end aperture of the output end outer conductor, and the output end front conductor supporting disk is fixedly mounted between the output end inner conductor and the output end microwave input connector; the output end microwave output connector is coaxially and fixedly connected to a rear end aperture of the output end outer conductor, and the output end rear conductor supporting disk is fixedly mounted between the output end inner conductor and the output end microwave output connector, and a coaxial state between the output end inner conductor and the output end outer conductor is maintained by the output end front conductor supporting disk and the output end rear conductor supporting disk; and the output end microwave input connector and the middle section microwave output connector are in coaxial threaded connection and matching.

A dry cooling air inlet is formed in the input end microwave input connector, a plurality of dry cooling air through holes are formed in the middle section conductor supporting disk and the output end front conductor supporting disk, and a plurality of dry cooling air exhaust holes are formed in the output end microwave output connector.

The input end inner conductor, the input end outer conductor, the input end microwave input connector, the input end microwave output connector, the middle section inner conductor, the middle section outer conductor, the middle section microwave input connector, the middle section microwave output connector, the output end inner conductor, the output end outer conductor, the output end microwave input connector, and the output end microwave output connector are all made of a conductive metal material; and the input end conductor supporting disk, the middle section conductor supporting disk, the output end front conductor supporting disk, and the output end rear conductor supporting disk are all made of a wave-transmitting material.

The microwave power adaptive regulation and control system includes an impedance matching regulator, a microwave power controller, and a temperature sensor; wherein one end of the impedance matching regulator is used for receiving the microwaves outputted by the high-power microwave generator, and the microwave incident power is recorded in the impedance matching regulator; the other end of the impedance matching regulator is used for outputting microwaves; the microwaves outputted by the impedance matching regulator are transmitted to the high-power microwave coaxial heater through the high-power low-loss microwave coaxial transmission line, and then the rock mass is fractured by the microwaves radiated from the high-power microwave coaxial heater; after the microwaves reflected by the rock mass return to the impedance matching regulator after passing through the high-power microwave coaxial heater and the high-power low-loss microwave coaxial transmission line sequentially, the microwave reflected power is recorded by the impedance matching regulator; the microwave power controller is used for receiving the microwave incident power and the microwave reflected power fed back by the impedance matching regulator; the temperature sensor is used for collecting temperature data of the rock mass during microwave fracturing, and the temperature data is directly fed back to the microwave power controller; reflection coefficient data of the rock mass is pre-set in the microwave power controller; the microwave power controller firstly takes the microwave incident power and the microwave reflected power fed back by the impedance matching regulator as the basis, and then calculates microwave power data satisfying impedance matching through the temperature data and the reflection coefficient data; and the microwave power controller finally feeds back the microwave power data satisfying impedance matching to the impedance matching regulator, and finally the real-time impedance matching is performed on the microwave power outputted by the high-power microwave generator through the impedance matching regulator.

The high-power microwave borehole fracturing device for an engineering rock mass has the beneficial effects that a high-power microwave generator, a high-power microwave coaxial heater, a high-power low-loss microwave coaxial transmission line, and a microwave power adaptive regulation and control system are all new designed therein. The high-power microwave generator effectively meets the practical engineering application requirements, and a permanent magnet is used in the high-power microwave generator for the first time to provide a magnetic field. At the same time, a coaxial circulator is used in the high-power microwave generator for the first time to isolate microwave reflected power, so that the structure of the high-power microwave generator can be more compact, the size is substantially reduced, and the conditions for combining with rock fracturing machinery are further provided. The high-power microwave coaxial heater has higher power capacity and larger microwave radiation range, so that the high-power borehole fracturing requirement can be met effectively, and breakdown sparking due to air ionization can be effectively avoided. The high-power low-loss microwave coaxial transmission line has higher power capacity, and the microwave energy loss during remote transmission is small, so that the high-power borehole fracturing requirement can be met effectively, and on-site assembly and disassembly are convenient. The microwave power adaptive regulation and control system achieves the adaptive regulation and control of the microwave power, when the load impedance of the rock changes dynamically, the real-time matching requirement of impedance can be met, the stability of the microwave equipment is effectively improved, the microwave reflected power is reduced to the maximum extent, and application requirements of the microwave-assisted rock fracturing technology in practical engineering are effectively met.

DETAILED DESCRIPTION OF THE PREFERRED EMBODIMENT

The present invention is described in details below with reference to the accompanying figures and specific embodiments.

Figure 1:
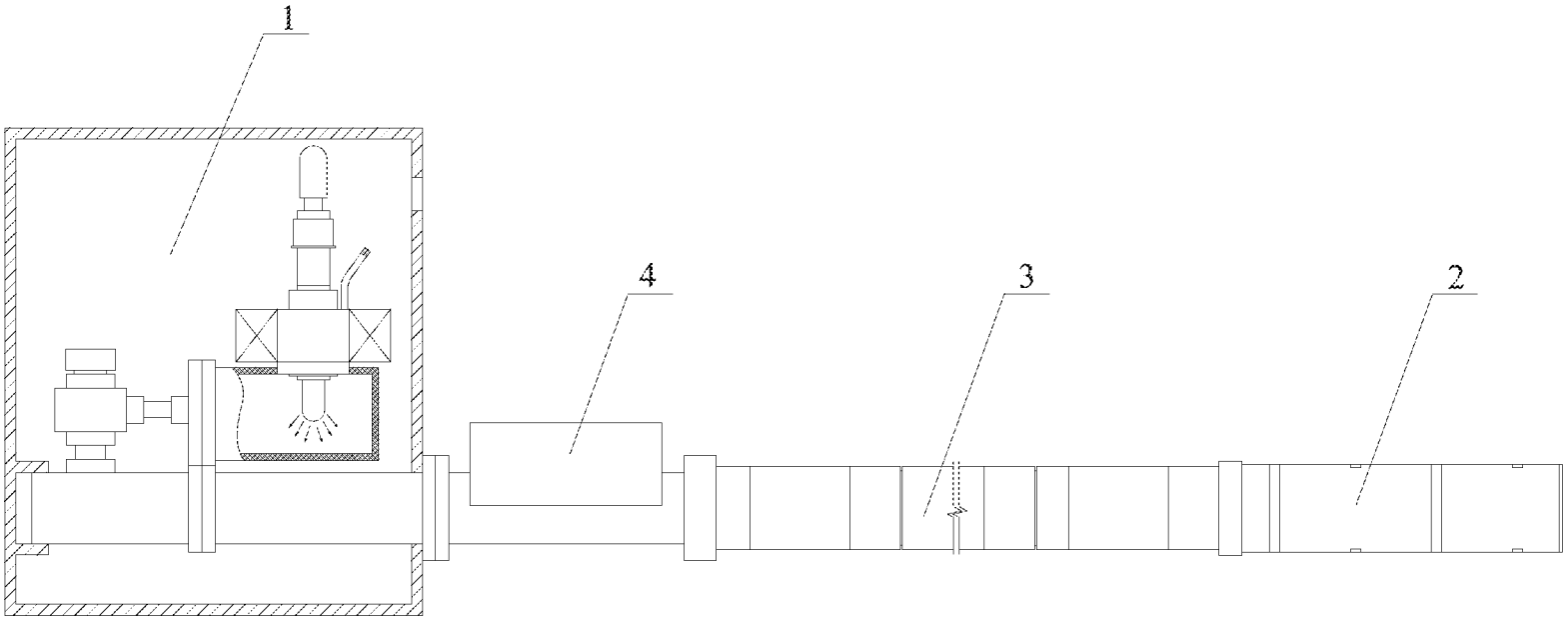
FIG. 1 is a schematic structural diagram of a high-power microwave borehole fracturing device for an engineering rock mass of the present invention.
Figure 2:
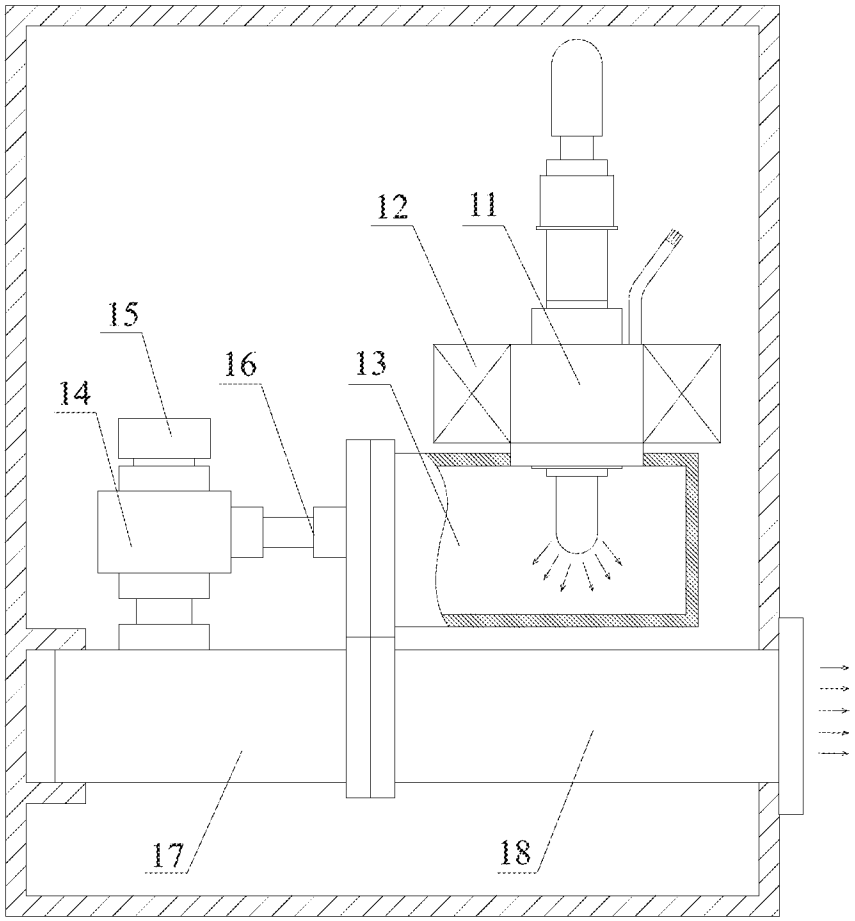
FIG. 2 is a schematic structural diagram of a high-power microwave generator of the present invention.
Figure 3:
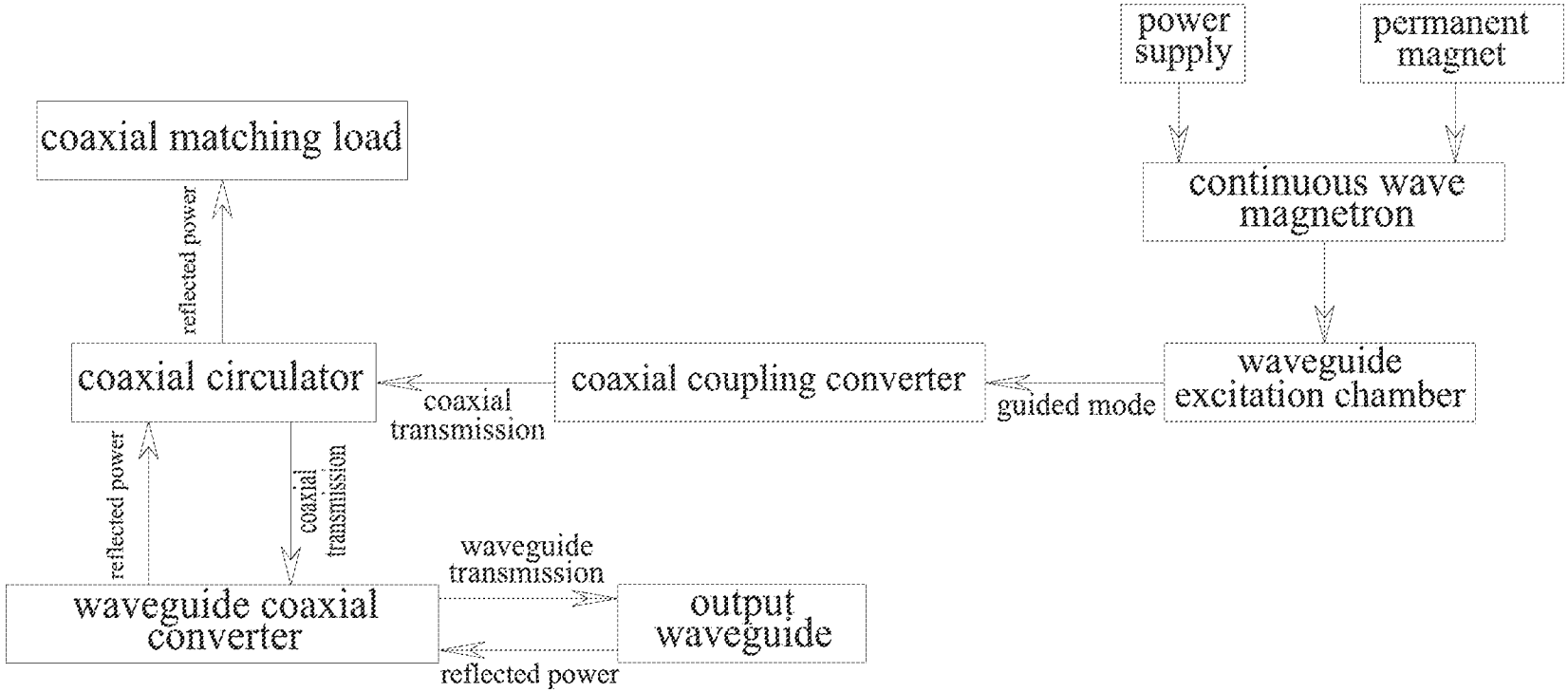
FIG. 3 is a work flow diagram of the high-power microwave generator of the present invention.
Figure 4:
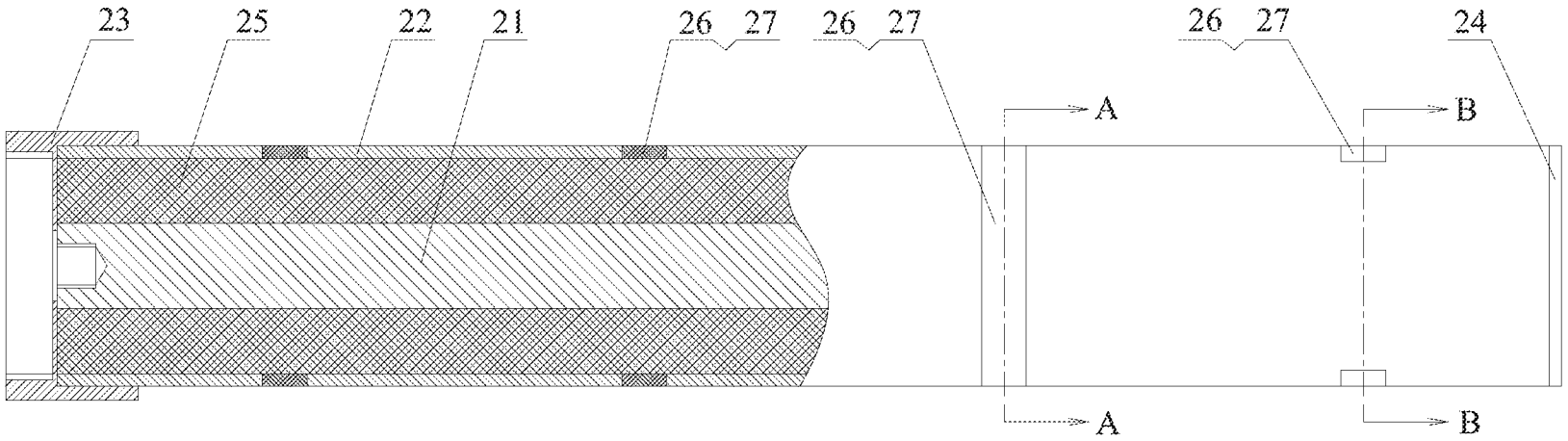
FIG. 4 is a schematic structural diagram of a high-power microwave coaxial heater of the present invention.
Figure 6:
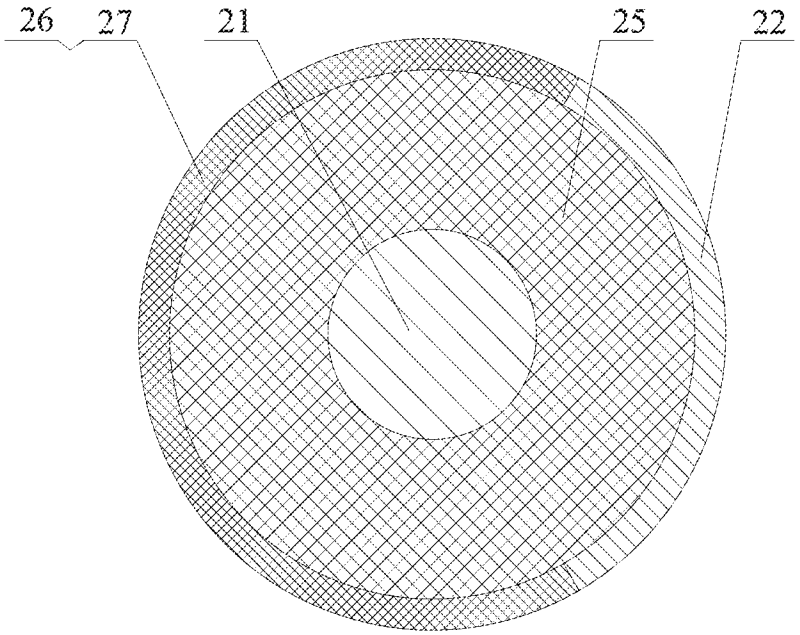
FIG. 6 is a cross-sectional view taken along line B-B of FIG. 4.
Figure 5:
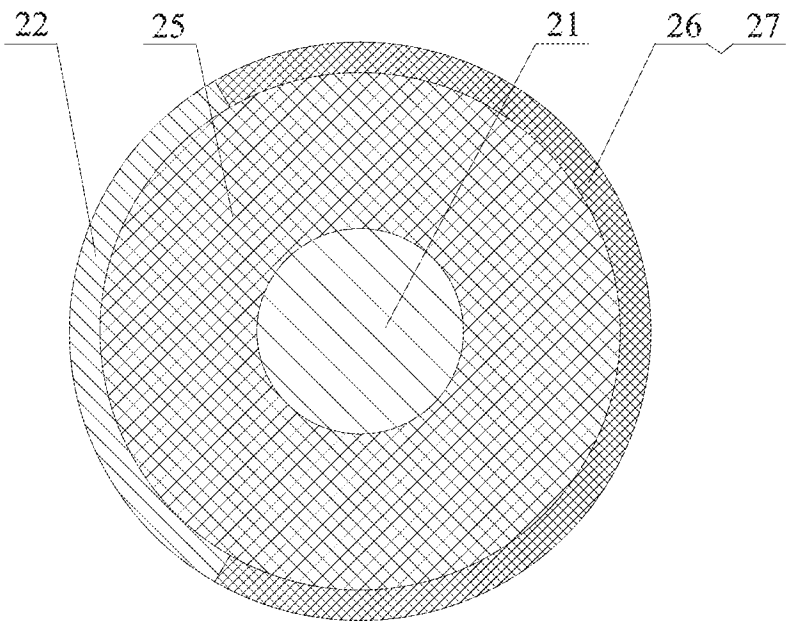
FIG. 5 is a cross-sectional view taken along line A-A of FIG. 4.
Figure 7:
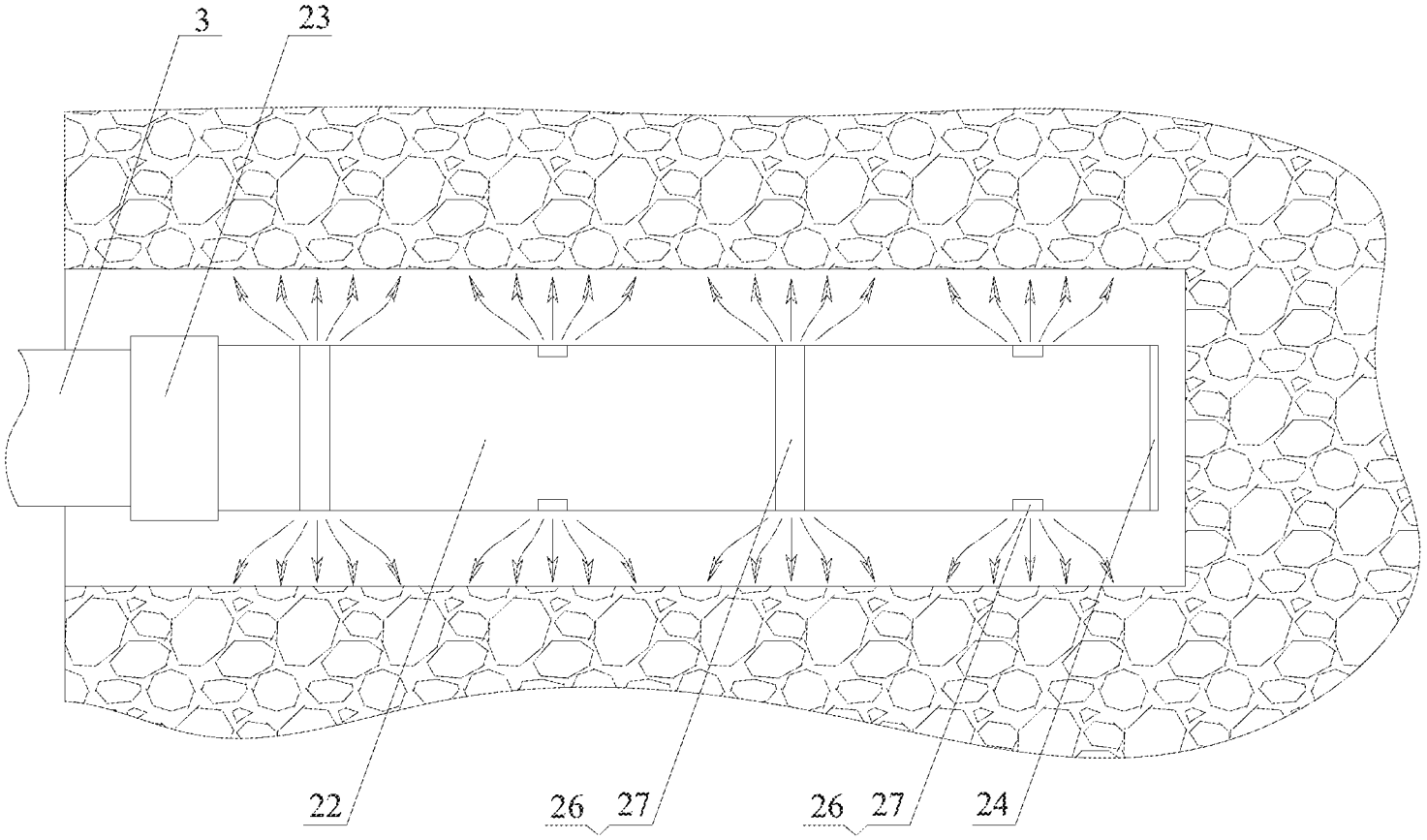
FIG. 7 is a work state diagram of the high-power microwave coaxial heater of the present invention.
Figure 8:
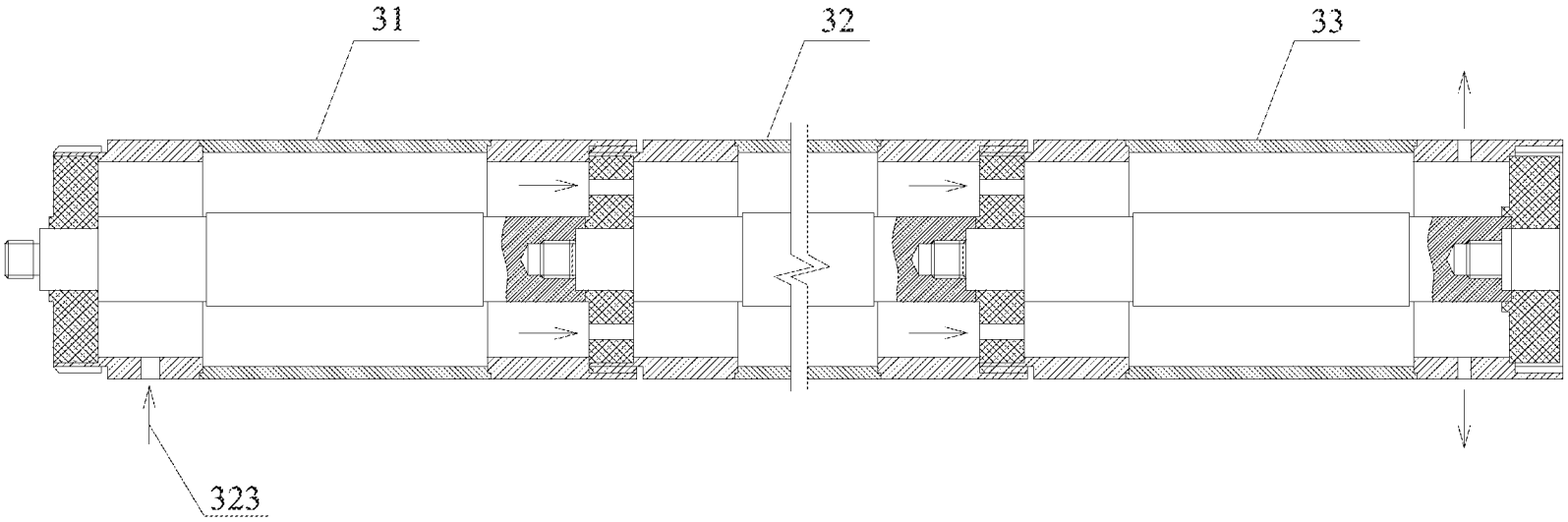
FIG. 8 is a schematic structural diagram of a high-power low-loss microwave coaxial transmission line of the present invention.
Figure 9:
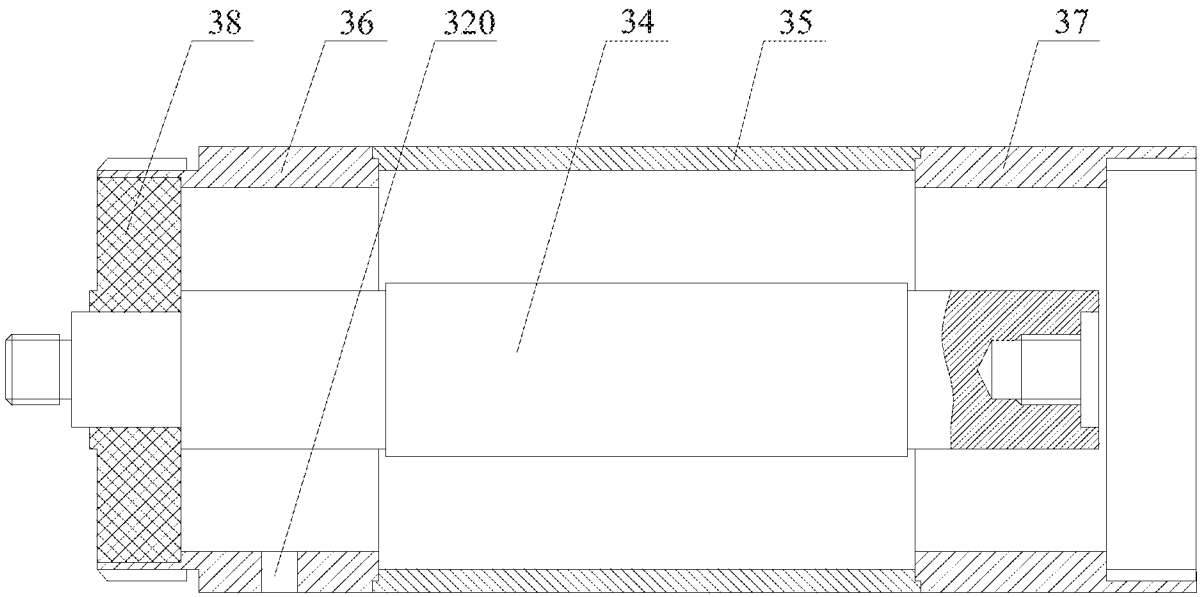
FIG. 9 is a schematic structural diagram of an input end coaxial line.
Figure 10:
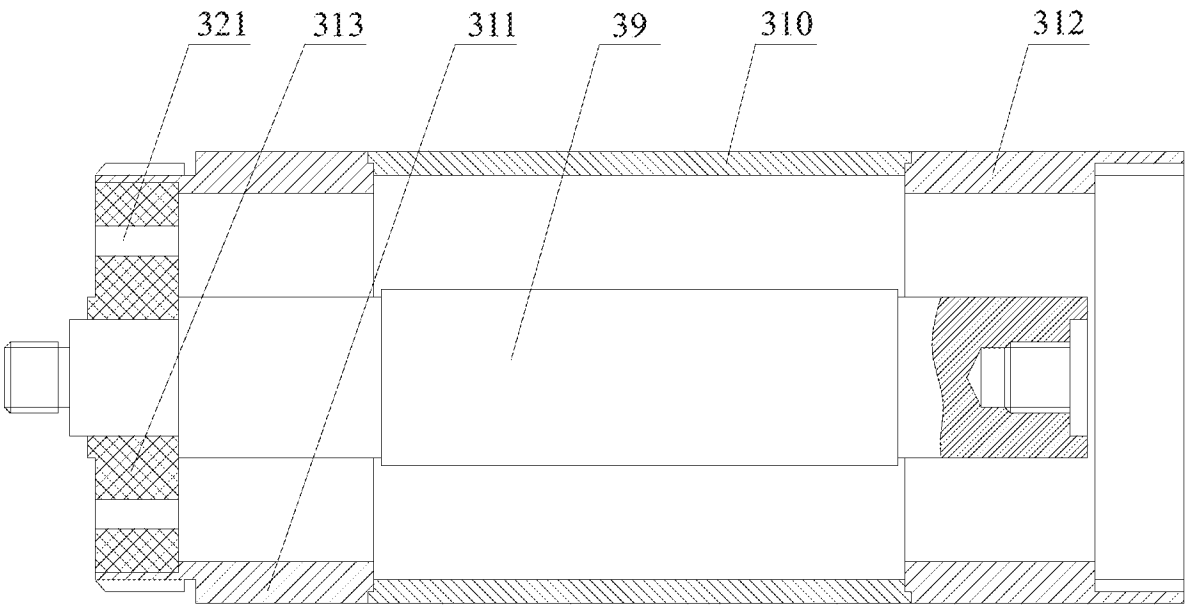
FIG. 10 is a schematic structural diagram of a middle section coaxial line.
Figure 11:
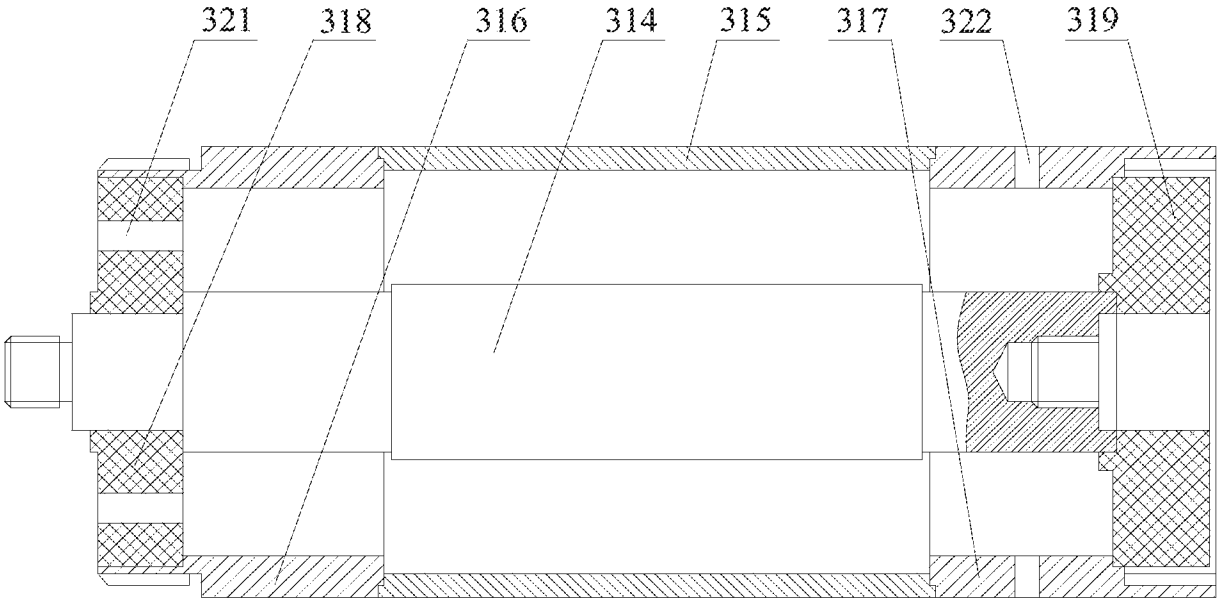
FIG. 11 is a schematic structural diagram of an output end coaxial line.
Figure 12:
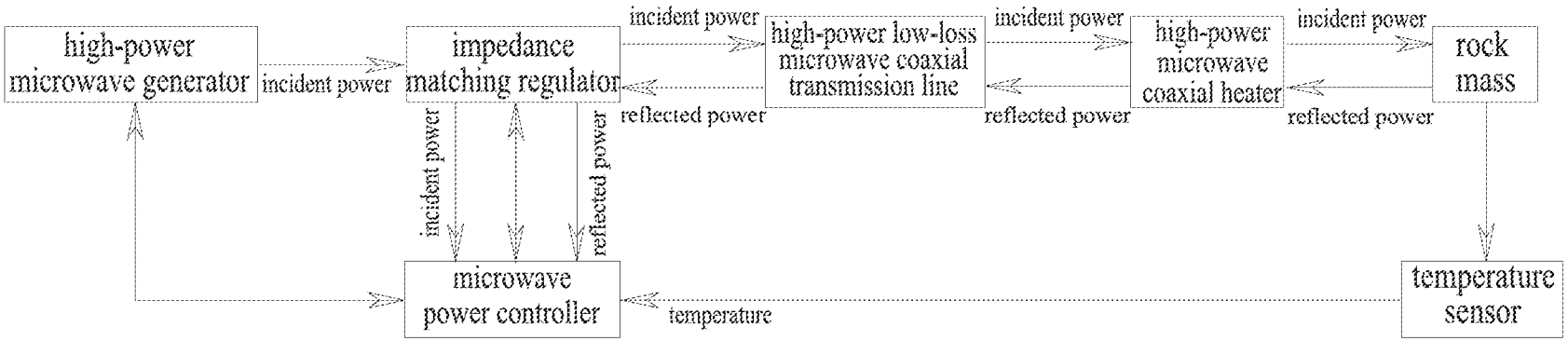
FIG. 12 is a structure block diagram of a microwave power adaptive regulation and control system of the present invention.

As shown in FIGS. 1-12, a high-power microwave borehole fracturing device for an engineering rock mass includes a high-power microwave generator 1, a high-power microwave coaxial heater 2, a high-power low-loss microwave coaxial transmission line 3, and a microwave power adaptive regulation and control system 4. The high-power microwave generator 1 is connected with the high-power microwave coaxial heater 2 through the microwave power adaptive regulation and control system 4 and the high-power low-loss microwave coaxial transmission line 3 sequentially. The high-power microwave coaxial heater 2 is used for radiating microwave energy to cause fracturing of rocks around a borehole of the engineering rock mass. The microwave power adaptive regulation and control system 4 is used for performing real-time impedance matching of a microwave power outputted by the high-power microwave generator 1. The high-power low-loss microwave coaxial transmission line 3 is used for transmitting impedance-matched microwaves into the high-power microwave coaxial heater 2.

The high-power microwave generator 1 includes a continuous wave magnetron 11, a permanent magnet 12, a waveguide excitation chamber 13, a coaxial circulator 14, a coaxial matching load 15, a coaxial coupling converter 16, a waveguide coaxial converter 17, and an output waveguide 18. The permanent magnet 12 is a circular ring structure, and the permanent magnet 12 is fixedly sleeved around an outer side of the continuous wave magnetron 11 to provide a magnetic field for the continuous wave magnetron 11. The continuous wave magnetron 11 is connected with a power supply through a wire, a microwave emitting head of the continuous wave magnetron 11 is located in the waveguide excitation chamber 13, DC electrical energy is converted into microwave energy by the continuous wave magnetron 11, the microwave energy generated by the continuous wave magnetron 11 enters the waveguide excitation chamber 13 through the microwave emitting head, and a guided mode is formed in the waveguide excitation chamber 13. Three end openings are formed in the coaxial circulator 14, and defined as a first end opening, a second end opening and a third end opening respectively. The waveguide excitation chamber 13 is connected with the first end opening of the coaxial circulator 14 through the coaxial coupling converter 16, and the microwave energy generated by the continuous wave magnetron 11 enters the coaxial circulator 14 after passing through the waveguide excitation chamber 13 and the coaxial coupling converter 16 sequentially. The output waveguide 18 is connected with the second end opening of the coaxial circulator 14 through the waveguide coaxial converter 17, the microwave energy in the coaxial circulator 14 enters the output waveguide 18 through the waveguide coaxial converter 17, and the microwave energy is converted from a coaxial output mode to a waveguide mode. The output waveguide 18 is a microwave output portion of the high-power microwave generator 1. The coaxial matching load 15 is connected to the third end opening of the coaxial circulator 14, and the coaxial matching load 15 is used for absorbing microwave reflected power isolated by the coaxial circulator 14 and protecting the coaxial circulator 14 and the continuous wave magnetron 11.

After the power supply of the continuous wave magnetron 11 is connected, the continuous wave magnetron 11 converts the DC electrical energy into microwave energy under the action of the magnetic field provided by the permanent magnet 12. The microwave energy firstly enters the waveguide excitation chamber 13 and forms the guided mode in the waveguide excitation chamber 13, and then enters the coaxial circulator 14 through the coaxial coupling converter 16. The microwave energy entering the coaxial circulator 14 can enter the output waveguide 18 through the waveguide coaxial converter 17. In the process, the microwave energy converts from the coaxial output mode to the waveguide mode. Finally, the microwave energy in the waveguide mode is directly outputted by the output waveguide 18 and transmitted to the high-power microwave coaxial heater 2 at the terminal through the high-power low-loss microwave coaxial transmission line 3.

After the high-power microwave coaxial heater 2 generates the microwave reflected power, the microwave reflected power enters the coaxial matching load 15 after passing through the high-power low-loss microwave coaxial transmission line 3, the output waveguide 18, the waveguide coaxial converter 17 and the coaxial circulator 14 sequentially, and the microwave reflected power isolated by the coaxial circulator 14 is absorbed by the coaxial matching load 15 for protecting the coaxial circulator 14 and the continuous wave magnetron 11.

The high-power microwave coaxial heater 2 includes a microwave transmission inner conductor 21, a microwave transmission outer conductor 22, a microwave input connector 23, a microwave short circuit cap 24, and a conductor supporting cylinder 25. The microwave transmission inner conductor 21 is a solid cylinder structure or a hollow cylinder structure, the microwave transmission outer conductor 22 is a cylindrical structure, the microwave transmission outer conductor 22 is coaxially sleeved around an outer side of the microwave transmission inner conductor 21, and the microwave transmission inner conductor 21 and the microwave transmission outer conductor 22 which are arranged in a coaxial sleeving state are fixedly mounted between the microwave input connector 23 and the microwave short circuit cap 24. An annular space is formed among the microwave transmission inner conductor 21, the microwave transmission outer conductor 22, the microwave input connector 23 and the microwave short circuit cap 24, and the annular space is stuffed by the conductor supporting cylinder 25 which maintains a coaxial state between the microwave transmission inner conductor 21 and the microwave transmission outer conductor 22. A plurality of microwave radiating openings 26 for radiating microwave energy outwards are formed in a cylinder wall of the microwave transmission outer conductor 22, and an anti-breakdown dielectric block 27 is stuffed in each of the microwave radiating openings 26.

The conductor supporting cylinder 25 and the anti-breakdown dielectric blocks 27 are both made of a wave-transmitting material. In the embodiment, polytetrafluoroethylene is selected as the wave-transmitting material. The microwave transmission inner conductor 21, the microwave transmission outer conductor 22, the microwave input connector 23 and the microwave short circuit cap 24 are all made of a conductive metal material. In the embodiment, copper is selected as the conductive metal material. Each of the microwave radiating openings 26 is in the shape of a curved slit, and a length of the curved slit of the microwave radiating opening 26 is equal to ⅔ of a circumference of the microwave transmission outer conductor 22. Due to the arrangement of the microwave radiating openings 26 in the shape of the curved slit, current lines of an inner wall of the microwave transmission outer conductor 22 are cut, and further the microwave radiating openings 26 are excited to radiate microwave energy outwards. The anti-breakdown dielectric blocks 27 are exactly the same as the microwave radiating openings 26 in shape and size, the microwave radiating openings 26 are distributed in an axial direction of the microwave transmission outer conductor 22 in an equidistant manner, and the adjacent microwave radiating openings 26 face oppositely. A distance between the adjacent microwave radiating openings 26 is $1/\sqrt{\varepsilon_r}$, wherein $\varepsilon_r$ is a relative dielectric constant of the wave-transmitting material. Since the conductor supporting cylinder 25 made of the wave-transmitting material is stuffed between the microwave transmission inner conductor 21 and the microwave transmission outer conductor 22, the distance between the adjacent microwave radiating openings 26 can be only $1/\sqrt{\varepsilon_r}$, and the number of microwave radiating openings 26 on the microwave transmission outer conductor 22 with a limited length is effectively increased, so that not only can the heating uniformity of the microwave radiation be guaranteed, but also a power capacity of the high-power microwave coaxial heater 2 is greatly increased. A distance between the microwave radiating opening 26 adjacent to the microwave short circuit cap 24 and the microwave short circuit cap 24 is ½λ, wherein $\lambda_p=\lambda\sqrt{\varepsilon_r}$; wherein $\lambda_p$ is a phase wavelength, λ is a microwave wavelength, and $\varepsilon_r$ is the relative dielectric constant of the wave-transmitting material. Therefore, a position of each microwave radiating opening 26 is guaranteed to be a wave peak of one of the microwaves, namely that each microwave radiating opening 26 can be excited to the maximum extent.

After the high-power low-loss microwave coaxial transmission line 3 is connected with the microwave input connector 23, the high-power microwave coaxial heater 2 can extend into the borehole of the rock mass. The microwave energy can enter the high-power microwave coaxial heater 2 through the high-power low-loss microwave coaxial transmission line 3, and firstly enters the annular space between the microwave transmission inner conductor 21 and the microwave transmission outer conductor 22. The current lines of the inner wall of the microwave transmission outer conductor 22 are cut by the microwave radiating openings 26 in the shape of the curved slit, so that the microwave radiating openings 26 can be excited to radiate microwave energy outwards. The radiated microwave energy is directly absorbed by the rocks around the borehole of the rock mass, so that the rocks around the borehole of the rock mass can be fractured.

When the microwave radiating openings 26 are used for high-power borehole microwave fracturing, due to the anti-breakdown dielectric blocks 27 made of the wave-transmitting material, a gap between the microwave radiating openings 26 can be prevented from being broken down even if the radiation field strength of the microwave radiating openings 26 is very high. In the embodiment, polytetrafluoroethylene is selected as the wave-transmitting material, of which the breakdown field strength can be up to 200 kV/mm, while the breakdown field strength of an air medium is only 30 kV/mm.

The high-power low-loss microwave coaxial transmission line 3 is a combined structure, and includes an input end coaxial line 31, middle section coaxial lines 32 and an output end coaxial line 33. The input end coaxial line 31 is connected with the output end coaxial line 33 through a plurality of middle section coaxial lines 32 connected in series.

The input end coaxial line 31 includes an input end inner conductor 34, an input end outer conductor 35, an input end microwave input connector 36, an input end microwave output connector 37, and an input end conductor supporting disk 38. The input end inner conductor 34 is a solid cylinder structure or a hollow cylinder structure, the input end outer conductor 35 is a cylindrical structure, and the input end outer conductor 35 is coaxially sleeved around an outer side of the input end inner conductor 34. The input end microwave input connector 36 is coaxially and fixedly connected to a front end aperture of the input end outer conductor 35, the input end conductor supporting disk 38 is fixedly mounted between the input end inner conductor 34 and the input end microwave input connector 36, and a coaxial state between the input end inner conductor 34 and the input end outer conductor 35 is maintained through the input end conductor supporting disk 38. The input end microwave output connector 37 is coaxially and fixedly connected to a rear end aperture of the input end outer conductor 35.

Each of the middle section coaxial lines 32 includes a middle section inner conductor 39, a middle section outer conductor 310, a middle section microwave input connector 311, a middle section microwave output connector 312, and a middle section conductor supporting disk 313. The middle section inner conductor 39 is a solid cylinder structure or a hollow cylinder structure, the middle section outer conductor 310 is a cylindrical structure, and the middle section outer conductor 310 is coaxially sleeved around an outer side of the middle section inner conductor 39. The middle section microwave input connector 311 is coaxially and fixedly connected to a front end aperture of the middle section outer conductor 310, the middle section conductor supporting disk 313 is fixedly mounted between the middle section inner conductor 39 and the middle section microwave input connector 311, and a coaxial state between the middle section inner conductor 39 and the middle section outer conductor 310 is maintained through the middle section conductor supporting disk 313. The middle section microwave output connector 312 is coaxially and fixedly connected to a rear end aperture of the middle section outer conductor 310. The middle section microwave input connector 311 and the input end microwave output connector 37 are in coaxial threaded connection and matching, or the middle section microwave input connector 311 and the middle section microwave output connector 312 of the adjacent middle section coaxial line 32 are in coaxial threaded connection and matching.

The output end coaxial line 33 includes an output end inner conductor 314, an output end outer conductor 315, an output end microwave input connector 316, an output end microwave output connector 317, an output end front conductor supporting disk 318, and an output end rear conductor supporting disk 319. The output end inner conductor 314 is a solid cylinder structure or a hollow cylinder structure, the output end outer conductor 315 is a cylindrical structure, and the output end outer conductor 315 is coaxially sleeved around an outer side of the output end inner conductor 314. The output end microwave input connector 316 is coaxially and fixedly connected to a front end aperture of the output end outer conductor 315, and the output end front conductor supporting disk 318 is fixedly mounted between the output end inner conductor 314 and the output end microwave input connector 316. The output end microwave output connector 317 is coaxially and fixedly connected to a rear end aperture of the output end outer conductor 315, and the output end rear conductor supporting disk 319 is fixedly mounted between the output end inner conductor 314 and the output end microwave output connector 317, and a coaxial state between the output end inner conductor 314 and the output end outer conductor 315 is maintained by the output end front conductor supporting disk 318 and the output end rear conductor supporting disk 319. The output end microwave input connector 316 and the middle section microwave output connector 312 are in coaxial threaded connection and matching.

A dry cooling air inlet 320 is formed in the input end microwave input connector 36, a plurality of dry cooling air through holes 321 are formed in the middle section conductor supporting disk 313 and the output end front conductor supporting disk 318, and a plurality of dry cooling air exhaust holes 322 are formed in the output end microwave output connector 317.

The input end inner conductor 34, the input end outer conductor 35, the input end microwave input connector 36, the input end microwave output connector 37, the middle section inner conductor 39, the middle section outer conductor 310, the middle section microwave input connector 311, the middle section microwave output connector 312, the output end inner conductor 314, the output end outer conductor 315, the output end microwave input connector 316, and the output end microwave output connector 317 are all made of a conductive metal material. In the embodiment, copper is selected as the conductive metal material.

The input end conductor supporting disk 38, the middle section conductor supporting disk 313, the output end front conductor supporting disk 318, and the output end rear conductor supporting disk 319 are all made of a wave-transmitting material. In the embodiment, polytetrafluoroethylene is selected as the wave-transmitting material.

In order to further increase the electrical conductivity between the outer conductors and the inner conductors to further reduce the transmission loss, a layer of low-resistivity material can be coated onto the inner surfaces of the outer conductors and the outer surfaces of the inner conductors.

Because the input end coaxial line 31 and one of the middle section coaxial lines 32, the adjacent middle section coaxial lines 32, and one of the middle section coaxial lines 32 and the output end coaxial line 33 are in threaded connection, good electrical contact between the outer conductors and the inner conductors is guaranteed, and excessive energy loss due to poor electrical contact is avoided; and besides, the threaded connection manner is more convenient for disassembly and assembly of the microwave coaxial transmission line 3 on site.

In order to prevent the microwave coaxial transmission line 3 from generating high heat while transmitting high-power microwaves, the microwave coaxial transmission line 3 is cooled in real time by dry cooling air 323 to prevent high temperature from adversely affecting the transmission characteristics of the air medium.

Before the high-power low-loss microwave coaxial transmission line 3 is used, the input end coaxial line 31, the middle section coaxial lines 32 and the output end coaxial line 33 in a dispersed state need to be assembled together in series, and the assembled high-power low-loss microwave coaxial transmission line 3 is connected between the microwave power adaptive regulation and control system 4 and the high-power microwave coaxial heater 2. Before microwave fracturing is performed, the dry cooling air inlet 320 needs to communicate with an air outlet of a dry cooler (not shown).

When microwave fracturing is performed, the dry cooler needs to be started. The high-power microwave firstly enters the input end coaxial line 31, and then is transmitted to the high-power microwave coaxial heater 2 after passing through the middle section coaxial lines 32 and the output end coaxial line 33 sequentially. Finally, the microwave energy is radiated outwards through the high-power microwave coaxial heater 2, and the radiated microwave energy is directly absorbed by the rocks around the borehole of the rock mass, so that the rocks around the borehole of the rock mass can be fractured.

In the process of high-power microwave transmission, the dry cooling air 323 outputted by the dry cooler passes through the input end coaxial line 31, the middle section coaxial lines 32 and the output end coaxial line 33 sequentially, until being exhausted from the dry cooling air exhaust holes 322. The microwave coaxial transmission line is cooled in real time by the dry cooling air 323 to prevent the high temperature from adversely affecting the transmission characteristics of the air medium.

The microwave power adaptive regulation and control system 4 includes an impedance matching regulator, a microwave power controller, and a temperature sensor. One end of the impedance matching regulator is used for receiving the microwaves outputted by the high-power microwave generator 1, and the microwave incident power is recorded in the impedance matching regulator. The other end of the impedance matching regulator is used for outputting microwaves The microwaves outputted by the impedance matching regulator are transmitted to the high-power microwave coaxial heater 2 through the high-power low-loss microwave coaxial transmission line 3, and then the rock mass is fractured by the microwaves radiated from the high-power microwave coaxial heater 2. After the microwaves reflected by the rock mass return to the impedance matching regulator after passing through the high-power microwave coaxial heater 2 and the high-power low-loss microwave coaxial transmission line 3 sequentially, the microwave reflected power is recorded by the impedance matching regulator, and the microwave power controller is used for receiving the microwave incident power and the microwave reflected power fed back by the impedance matching regulator. The temperature sensor is used for collecting temperature data of the rock mass during microwave fracturing, and the temperature data is directly fed back to the microwave power controller. Reflection coefficient data of the rock mass is pre-set in the microwave power controller. The microwave power controller firstly takes the microwave incident power and the microwave reflected power fed back by the impedance matching regulator as the basis, and then calculates microwave power data satisfying impedance matching through the temperature data and the reflection coefficient data. And the microwave power controller finally feeds back the microwave power data satisfying impedance matching to the impedance matching regulator, and finally the real-time impedance matching is performed on the microwave power outputted by the high-power microwave generator 1 through the impedance matching regulator.

A microwave power adaptive regulation and control method includes the steps of: starting the high-power microwave generator 1, inputting microwaves into the impedance matching regulator through the high-power microwave generator 1, and performing initial matching regulation on the input microwave power through the impedance matching regulator; after the microwave power is regulated through initial matching, transmitting the microwaves outputted by the impedance matching regulator to the high-power microwave coaxial heater 2 through the high-power low-loss microwave coaxial transmission line 3, and then enabling the rock mass to be fractured by the microwaves radiated from the high-power microwave coaxial heater 2, wherein Some of the microwave energy can be absorbed by the rock mass, and some of the microwave energy is reflected back into the impedance matching regulator through the high-power microwave coaxial heater 2 and the high-power low-loss microwave coaxial transmission line 3 sequentially, and the microwave incident power and the microwave reflected power are recorded by the impedance matching regulator; feeding the temperature data of the rock mass collected by the temperature sensor during microwave fracturing to the microwave power controller, wherein the microwave power controller takes the microwave incident power and the microwave reflected power fed back by the impedance matching regulator as the basis, and then calculating the microwave power data satisfying impedance matching through the temperature data and the reflection coefficient data; and feeding back the microwave power data satisfying impedance matching to the impedance matching regulator through the microwave power controller, and performing real-time impedance matching on the microwave power outputted by the high-power microwave generator 1 through the impedance matching regulator.

In the embodiment, the microwave power controller is a programmable logic controller (PLC), and a power regulation model is established in the PLC by a proportional integral differential (PID) algorithm. The PLC drives the impedance matching regulator through the power regulation model to establish a mathematical model or a data sheet, for quickly forming microwave power control information in the PLC, so that the impedance matching regulator can quickly achieve impedance matching. The microwave power regulated through impedance matching is then radiated to the rock mass by the high-power microwave coaxial heater 2 for fracturing, so that the microwave reflected power can be reduced to the minimum.

In the embodiment, in order to obtain the pre-set reflection coefficient data of the rock mass, an effective dielectric constant of the rock mass needs to be measured in advance and characterized by using a binomial expansion, and then the obtained characterization formula of the effective dielectric constant is substituted into a model of the high-power microwave coaxial heater 2 for simulation calculation, so that corresponding relation between the reflection coefficient and the effective dielectric constant of the rock mass can be obtained. Since the reflection coefficient is determined by the effective dielectric constant of the rock mass, the reflection coefficient and the effective dielectric constant of the rock mass form one-to-one corresponding relation, and the effective dielectric constant of the rock mass and the temperature data of the rock mass also form a one-to-one corresponding relation. Therefore, the microwave power data satisfying impedance matching can be calculated through the reflection coefficient and the temperature data.

The scheme in the embodiment is not intended to limit the scope of patent protection of the present invention. Any equivalent implementation or modification without departing from the present invention should be included in the scope of patent of the present invention.

What is claimed is:

1. A high-power microwave borehole fracturing device for an engineering rock mass, comprising a high-power microwave generator, a high-power microwave coaxial heater, a high-power low-loss microwave coaxial transmission line, and a microwave power adaptive regulation and control system; wherein the high-power microwave generator is connected with the high-power microwave coaxial heater through the microwave power adaptive regulation and control system and the high-power low-loss microwave coaxial transmission line sequentially; the high-power microwave coaxial heater is used for radiating microwave energy to cause fracturing of rocks around a borehole of the engineering rock mass; the microwave power adaptive regulation and control system is used for performing real-time impedance matching of a microwave power outputted by the high-power microwave generator; and the high-power low-loss microwave coaxial transmission line is used for transmitting impedance-matched microwaves into the high-power microwave coaxial heater, wherein the microwave power adaptive regulation and control system comprises an impedance matching regulator, a microwave power controller, and a temperature sensor; wherein one end of the impedance matching regulator is used for receiving the microwaves outputted by the high-power microwave generator, and a microwave incident power is recorded in the impedance matching regulator; the other end of the impedance matching regulator is used for outputting microwaves; the microwaves outputted by the impedance matching regulator are transmitted to the high-power microwave coaxial heater through the high-power low-loss microwave coaxial transmission line, and then the rock mass is fractured by the microwaves radiated from the high-power microwave coaxial heater; after the microwaves reflected by the rock mass return to the impedance matching regulator after passing through the high-power microwave coaxial heater and the high-power low-loss microwave coaxial transmission line sequentially, a microwave reflected power is recorded by the impedance matching regulator; the microwave power controller is used for receiving the microwave incident power and the microwave reflected power fed back by the impedance matching regulator; the temperature sensor is used for collecting temperature data of the rock mass during microwave fracturing, and the temperature data is directly fed back to the microwave power controller; reflection coefficient data of the rock mass is pre-set in the microwave power controller; the microwave power controller firstly takes the microwave incident power and the microwave reflected power fed back by the impedance matching regulator as the basis, and then calculates microwave power data satisfying impedance matching through the temperature data and the reflection coefficient data; and the microwave power controller finally feeds back the microwave power data satisfying impedance matching to the impedance matching regulator, and finally the real-time impedance matching is performed on the microwave power outputted by the high-power microwave generator through the impedance matching regulator.

2. The high-power microwave borehole fracturing device for an engineering rock mass according to claim 1, wherein the high-power microwave generator comprises a continuous wave magnetron, a permanent magnet, a waveguide excitation chamber, a coaxial circulator, a coaxial matching load, a coaxial coupling converter, a waveguide coaxial converter, and an output waveguide; wherein the permanent magnet is a circular ring structure, and the permanent magnet is fixedly sleeved around an outer side of the continuous wave magnetron to provide a magnetic field for the continuous wave magnetron; the continuous wave magnetron is connected with a power supply through a wire, a microwave emitting head of the continuous wave magnetron is located in the waveguide excitation chamber, DC electrical energy is converted into microwave energy by the continuous wave magnetron, the microwave energy generated by the continuous wave magnetron enters the waveguide excitation chamber through the microwave emitting head, and a guided mode is formed in the waveguide excitation chamber; three end openings are formed in the coaxial circulator, and defined as a first end opening, a second end opening and a third end opening respectively; the waveguide excitation chamber is connected with the first end opening of the coaxial circulator through the coaxial coupling converter, and the microwave energy generated by the continuous wave magnetron enters the coaxial circulator after passing through the waveguide excitation chamber and the coaxial coupling converter sequentially; the output waveguide is connected with the second end opening of the coaxial circulator through the waveguide coaxial converter, the microwave energy in the coaxial circulator enters the output waveguide through the waveguide coaxial converter, and the microwave energy is converted from a coaxial output mode to a waveguide mode; the output waveguide is a microwave output portion of the high-power microwave generator; and the coaxial matching load is connected to the third end opening of the coaxial circulator, and the coaxial matching load is used for absorbing the microwave reflected power isolated by the coaxial circulator and protecting the coaxial circulator and the continuous wave magnetron.

3. The high-power microwave borehole fracturing device for an engineering rock mass according to claim 1, wherein the high-power microwave coaxial heater comprises a microwave transmission inner conductor, a microwave transmission outer conductor, a microwave input connector, a microwave short circuit cap, and a conductor supporting cylinder; wherein the microwave transmission inner conductor is a solid cylinder structure or a hollow cylinder structure, the microwave transmission outer conductor is a cylindrical structure, the microwave transmission outer conductor is coaxially sleeved around an outer side of the microwave transmission inner conductor, and the microwave transmission inner conductor and the microwave transmission outer conductor which are arranged in a coaxial sleeving state are fixedly mounted between the microwave input connector and the microwave short circuit cap; an annular space is formed among the microwave transmission inner conductor, the microwave transmission outer conductor, the microwave input connector and the microwave short circuit cap, and the annular space is stuffed by the conductor supporting cylinder which maintains a coaxial state between the microwave transmission inner conductor and the microwave transmission outer conductor; and a plurality of microwave radiating openings for radiating microwave energy outwards are formed in a cylinder wall of the microwave transmission outer conductor, and an anti-breakdown dielectric block is stuffed in each of the microwave radiating openings.

4. The high-power microwave borehole fracturing device for an engineering rock mass according to claim 3, wherein the conductor supporting cylinder and the anti-breakdown dielectric blocks are both made of a wave-transmitting material; the microwave transmission inner conductor, the microwave transmission outer conductor, the microwave input connector and the microwave short circuit cap are all made of a conductive metal material; each of the microwave radiating openings is in the shape of a curved slit, and a length of the curved slit of the microwave radiating opening is equal to ⅔ of a circumference of the microwave transmission outer conductor; the anti-breakdown dielectric blocks are exactly the same as the microwave radiating openings in shape and size, the microwave radiating openings are distributed in an axial direction of the microwave transmission outer conductor in an equidistant manner, and the adjacent microwave radiating openings face oppositely; a distance between the adjacent microwave radiating openings is $1/\sqrt{\varepsilon_r}$, wherein $\varepsilon_r$ is a relative dielectric constant of the wave-transmitting material; and a distance between the microwave radiating opening adjacent to the microwave short circuit cap and the microwave short circuit cap is $\frac{1}{2}\lambda_p$, wherein $\lambda_p=\lambda\sqrt{\varepsilon_r}$; wherein $\lambda_p$ is a phase wavelength, $\lambda$ is a microwave wavelength, and $\varepsilon_r$ is the relative dielectric constant of the wave-transmitting material.

5. The high-power microwave borehole fracturing device for an engineering rock mass according to claim 1, wherein the high-power low-loss microwave coaxial transmission line is a combined structure, and comprises an input end coaxial line, middle section coaxial lines, and an output end coaxial line, wherein the input end coaxial line is connected with the output end coaxial line through a plurality of middle section coaxial lines connected in series; the input end coaxial line comprises an input end inner conductor, an input end outer conductor, an input end microwave input connector, an input end microwave output connector, and an input end conductor supporting disk; wherein the input end inner conductor is a solid cylinder structure or a hollow cylinder structure, the input end outer conductor is a cylindrical structure, and the input end outer conductor is coaxially sleeved around an outer side of the input end inner conductor; the input end microwave input connector is coaxially and fixedly connected to a front end aperture of the input end outer conductor, the input end conductor supporting disk is fixedly mounted between the input end inner conductor and the input end microwave input connector, and a coaxial state between the input end inner conductor and the input end outer conductor is maintained through the input end conductor supporting disk; and the input end microwave output connector is coaxially and fixedly connected to a rear end aperture of the input end outer conductor.

6. The high-power microwave borehole fracturing device for an engineering rock mass according to claim 5, wherein each of the middle section coaxial lines comprises a middle section inner conductor, a middle section outer conductor, a middle section microwave input connector, a middle section microwave output connector, and a middle section conductor supporting disk; wherein the middle section inner conductor is a solid cylinder structure or a hollow cylinder structure, the middle section outer conductor is a cylindrical structure, and the middle section outer conductor is coaxially sleeved around an outer side of the middle section inner conductor; the middle section microwave input connector is coaxially and fixedly connected to a front end aperture of the middle section outer conductor, the middle section conductor supporting disk is fixedly mounted between the middle section inner conductor and the middle section microwave input connector, and a coaxial state between the middle section inner conductor and the middle section outer conductor is maintained through the middle section conductor supporting disk; the middle section microwave output connector is coaxially and fixedly connected to a rear end aperture of the middle section outer conductor; and the middle section microwave input connector and the input end microwave output connector are in coaxial threaded connection and matching, or the middle section microwave input connector and the middle section microwave output connector of the adjacent middle section coaxial line are in coaxial threaded connection and matching.

7. The high-power microwave borehole fracturing device for an engineering rock mass according to claim 6, wherein the output end coaxial line comprises an output end inner conductor, an output end outer conductor, an output end microwave input connector, an output end microwave output connector, an output end front conductor supporting disk, and an output end rear conductor supporting disk; wherein the output end inner conductor is a solid cylinder structure or a hollow cylinder structure, the output end outer conductor is a cylindrical structure, and the output end outer conductor is coaxially sleeved around an outer side of the output end inner conductor; the output end microwave input connector is coaxially and fixedly connected to a front end aperture of the output end outer conductor, and the output end front conductor supporting disk is fixedly mounted between the output end inner conductor and the output end microwave input connector; the output end microwave output connector is coaxially and fixedly connected to a rear end aperture of the output end outer conductor, and the output end rear conductor supporting disk is fixedly mounted between the output end inner conductor and the output end microwave output connector, and a coaxial state between the output end inner conductor and the output end outer conductor is maintained by the output end front conductor supporting disk and the output end rear conductor supporting disk; and the output end microwave input connector and the middle section microwave output connector are in coaxial threaded connection and matching.

8. The high-power microwave borehole fracturing device for an engineering rock mass according to claim 7, wherein a dry cooling air inlet is formed in the input end microwave input connector, a plurality of dry cooling air through holes are formed in the middle section conductor supporting disk and the output end front conductor supporting disk, and a plurality of dry cooling air exhaust holes are formed in the output end microwave output connector.

9. The high-power microwave borehole fracturing device for an engineering rock mass according to claim 7, wherein the input end inner conductor, the input end outer conductor, the input end microwave input connector, the input end microwave output connector, the middle section inner conductor, the middle section outer conductor, the middle section microwave input connector, the middle section microwave output connector, the output end inner conductor, the output end outer conductor, the output end microwave input connector, and the output end microwave output connector are all made of a conductive metal material; and the input end conductor supporting disk, the middle section conductor supporting disk, the output end front conductor supporting disk, and the output end rear conductor supporting disk are all made of a wave-transmitting material.

* * * * *